United States Patent [19]

Mansgold et al.

[11] 4,425,481

[45] Jan. 10, 1984

[54] PROGRAMMABLE SIGNAL PROCESSING DEVICE

[76] Inventors: Stephan Mansgold, Rådavägen 82 G, Mölnlycke, Sweden, S-435 00; Arne Leijon, Jungmansgatan 57, Göteborg, Sweden, S-413 11; Björn Israelsson, Uddevallagatan 35, Göteborg, Sweden, S-416 70

[21] Appl. No.: 368,456

[22] Filed: Apr. 14, 1982

[30] Foreign Application Priority Data

Apr. 16, 1981 [SE] Sweden ..... 8102466

[51] Int. Cl.[3] ..... H04R 25/00

[52] U.S. Cl. ..... 179/107 FD; 381/68

[58] Field of Search ..... 179/107 R, 107 FD, 107 H, 179/1 D; 364/108

[56] References Cited

U.S. PATENT DOCUMENTS 4,025,721 5/1977 Graupe et al. ..... 179/107 FD 4,187,413 2/1980 Moser ..... 179/107 FD

FOREIGN PATENT DOCUMENTS 2091065 7/1982 United Kingdom ..... 179/107 FD

OTHER PUBLICATIONS

S. Knorr, "A hearing Aid . . . ," *IEEE Transactions on Acoustics, Speech, & Signal Processing,* vol. ASSP-24, No. 6, pp. 473–480, Dec. 1976.

A. Rihs, et al., "Active Filtering . . . ," *Hearing Instruments,* vol. 33, No. 10, p. 20, Oct. 1982.

*Primary Examiner*—G. Z. Rubinson

*Assistant Examiner*—L. C. Schroeder

[57] ABSTRACT

The invention refers to a programmable signal processing device mainly intended for hearing aids and of the kind which include an electronically controlled signal processor. Hearing aids for persons having impaired hearing are normally adjusted for only one frequency response and are adapted to amplify the frequencies which the patient has difficulties to hear. At different sound environments as for example conversations with disturbing background sounds, normal conversation in quiet environments or at lectures, the conditions of listening are different. Up to now this problem has not been solved satisfactorily for hearing aids. With the present invention a number of different signal processes, can easily be selected to suit different sound situations automatically or by the user himself. This is accomplished thereby that a memory (6) is arranged to store information/data for at least two unique signal processes adjusted to different sound environments/listening situations and that a control unit (5), manual or automatic, is arranged to transmit information/data, for one of the unique signal processes, from the memory (6) to the signal processor (4), to bring about one signal process adjusted to a particular sound environment/listening situation. (FIG. 1)

5 Claims, 2 Drawing Figures

5
4
6
34
35
21
36
19
27
24
25
8
26
20c
20b
20a
22a
22b
23a
23b
23c
23d
18a
18b
18c
18d
18e
18f
18g
18h
14a
14b
14c
14d
14e
15
9
17
28
33
29
13c
13b
13a
10
11
7
16
3

PROGRAMMABLE SIGNAL PROCESSING DEVICE

The present invention refers to a programmable signal processing device, mainly intended for hearing aids, and of the kind which includes an electronically controlled signal processor.

BACKGROUND OF THE INVENTION

Impaired hearing is today a very common handicap. It is above all, elderly people and people who are exposed to loud noise, that are affected. We do not discuss the causes of impairments in detail here, but only note that today it is practically impossible to treat these impairments in a medical way. The most common method today to re-establish, at least partly, the hearing of the affected patient, is to let the patient use some type of hearing aid. High demands must be put on such hearing aids, i.e. their frequency response must be adjusted to the patients hearing deficiency and it must also be possible to amplify desired sounds as for example normal conversation. To suit all normally occurring environmental situations it is not unusual that the same patient today has two or more hearing aids, which he or she alters between. The hearing aids must also be small and convenient to use.

Today there exist about a hundred different types of hearing aids on the market and it is therefore difficult for the person responsible for the fitting to decide which one is optimal in the individual case.

An estimate is that one out of four hearing aids is not acceptable by the patient and therfore the hearing aid is not used. As about 2.3 million hearing aids (1980) are distributed in the world every year, there is a great need for improving the devices and to develop more accurate and simplified fitting methods.

It would also be desirable to reduce the number of hearing aid types on the market to a few main types on condition that these main types can be adapted to each individual need.

Different types of filters with variable frequency response are earlier disclosed in the patent literature. Such filters are for example disclosed in the U.S. Pat. No. 3,989,904 filed Dec. 30, 1974, with the title "Method and apparatus for setting an aural prosthetis to provide specific auditory deficiency corrections", and in the Danish Patent Publication No. 138.149, filed Feb. 23, 1973, with the title "Kobling til brug i et höreapparat og i et apparat til måling af menneskelige höredefekter".

The American invention refers to a device intended for adjusting a hearing aid in such a way that the gain in different frequency bands and maximum power output can be adjusted at the fitting procedure. The device has a number of disadvantages. For example the hearing aid can be optimal in adjusted for only one sound environment.

The Danish invention refers to a similar device where every filter individually can be adjusted with respect to the amplification. In this invention also only one frequency response can be set and the patient can hear well or optimally in just one sound environment, for example at normal conversations at home, while the device can be practically impossible to use in other sound environments, such as for example at place of work with disturbing background noises, traffic environment or at meetings, parties and the like.

In the U.S. Pat. No. 4,187,413 is further disclosed a hearing aid which includes a memory multiplexer for loading of multiplier coefficients for adapting the transfer function to different types of hearing deficiency. The hearing aid is possible to reprogram without disassembly. The programmed parameters are however related to one present hearing deficiency and not to various listening situations which can occur. I.e. only one signal process can be programmed at one time. There are therefor not any possibility to alter between a number of different signal processes suitable for various sound environments.

THE OBJECTS OF THE INVENTION

An object of the invention is to provide a programmable signal processing device which automatically, or controlled by the user, select the signal process, which is best suited to the particular sound environment. Further objects of the invention are that the signal processing device should be easy to use and comfortable to wear for the person with impaired hearing, easy to adjust/program and cheap to produce.

By means of such a signal processing device the following functions among others could be maintained.

- Variation of the amplification as a function of frequency.
- Variation of the limit level as a function of frequency.
- Variation of the compression threshold and ratio in AGC (Automatic Gain Control) as a function of frequency.
- Variation of attack and release times of AGC.
- A combination of expansion and compression as a function of frequency.
- Non-linear amplification as a function of frequency.
- Frequency conversion upwards or downwards in frequency.
- Recording of frequency changes in the signal, for example formant transitions in speech sounds.
- Variation of the balance of the microphone and pick-up-coil.

Of course it is also possible to implement other analog and/or digital signal processes. This is achieved thereby that a memory is arranged to store information/data for at least two unique signal process adjusted to different sound environments/listening situations and that a control unit, manual or automatic, is arranged to transmit information/data, for one of the unique signal processes, from the memory to the signal processor, to bring about one signal process adjusted to the particular sound environment/listening situation.

BRIEF DESCRIPTION OF DRAWINGS

The invention will be described in a preferred embodiment in the following text with reference to the attached drawings.

DESCRIPTION OF THE PREFERRED EMBODIMENT

Figure 1:
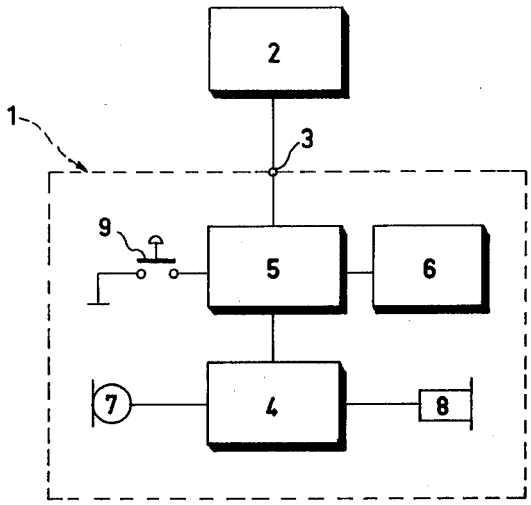
FIG. 1 shows a block diagram of a signal processing device according to the invention and an external programming unit connected to it.

FIG. 1 shows a signal processing device 1 according to the invention, and to which an external programming unit 2 can be connected via an input/output terminal 3. By means of the programming unit 2 information can be read in to, or out from, a memory 6. The signal processing device 1 consists mainly of a signal processor 4, a control unit 5, a memory 6, a microphone 7, an earphone 8 and a control gear 9, such as a switch, arranged to change the signal process of the signal processing device 1.

The signal processing device 1 is arranged thus that by manually activating the switch 9, or automatically by command from the signal processing unit 4, the control unit 5 transfers new information from the memory 6 to the signal processor 4 thereby specifying the signal process.

Figure 2:
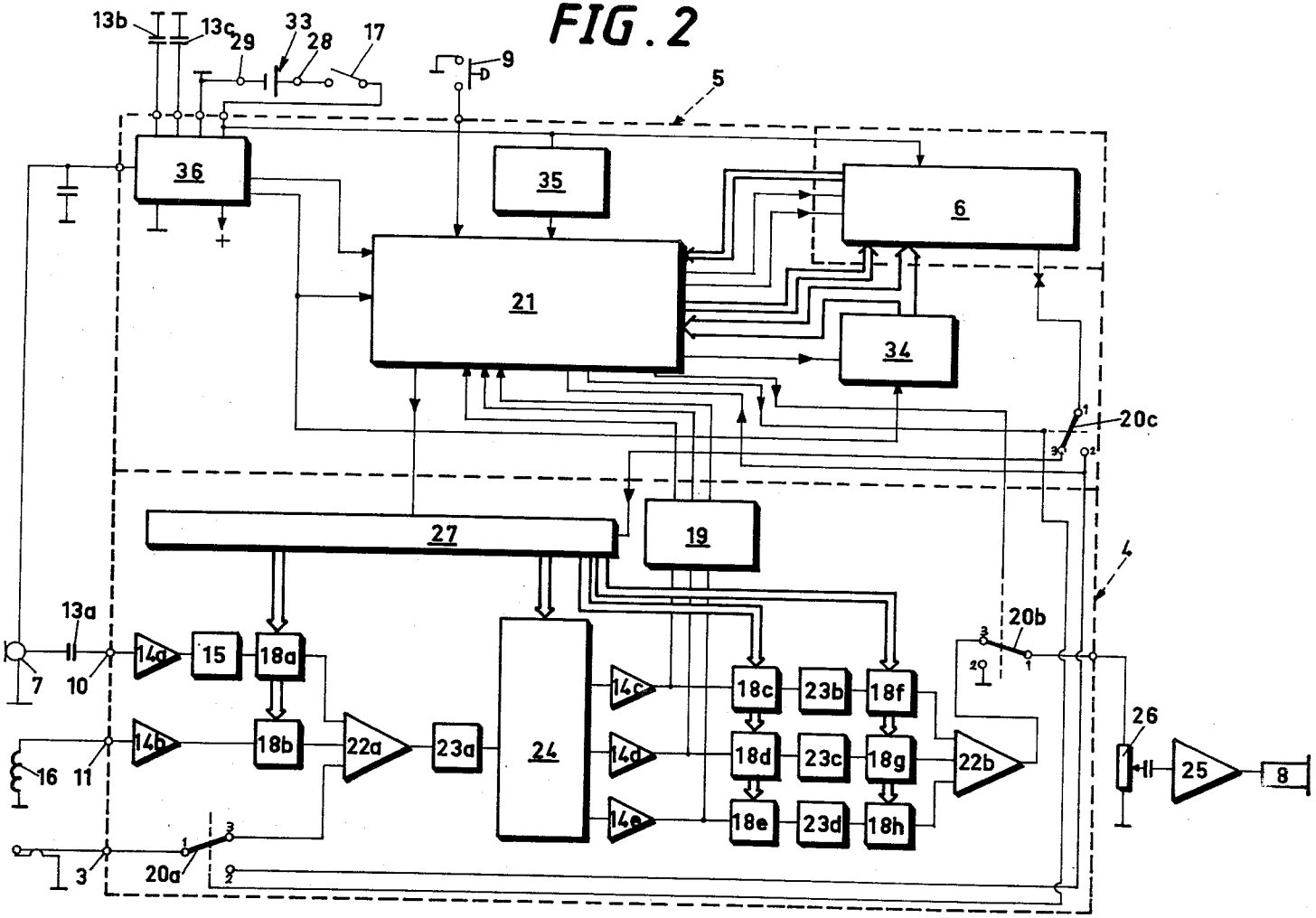
FIG. 2 shows a more detailed block diagram of the electronic circuits of the invention.

FIG. 2 shows a more detailed block diagram of the signal processing device 1. The signal processor 4 can be constructed with different techniques i.e. analog or digital signal processing, and with a variety of different signal processing systems. To clarify it is given one example of a signal processing system, which is based upon the principle that the input signal is split up in three frequency bands and each of the three signals is limited and attenuated. This signal processor 4 is based on analog technique all integrated on one chip using bipolar technology.

The control unit 5 and memory 6 are based on digital technique, all integrated in one chip using CMOS technology. The memory 6 is of non-volatile CMOS-type, in this case organized in $1\times643$ bits.

The signal processor 4 has two input terminals 10 and 11, and one input/output terminals 3. A microphone 7 is connected to input 10 and a tele- or pick-up-coil 16 to input 11. The input/output terminal 3 is used as galvanic audio input or can be connected to an external programming unit 2 so that data can be written into the memory 6 or read out from the memory 6 to the programming unit 2.

A digitally controlled two-way switch 20*a*, which is controlled by the logic unit 21, is activated when data is transferred in or out.

The signal from the microphone 7 passes a capacitor 13*a* and is amplified 30 dB in the microphone amplifier 14*a* and then filtered in a high pass filter 15 ($f_c=200$ Hz, 6 dB/octave). The signal from the pick-up-coil 16 is amplified 30 dB in the pick-up-coil amplifier 14*b*.

These two different signals are then attenuated (0–40 dB) in two digitally controlled attenuators 18*a*, 18*b*. The analog signals can also be electronically disconnected by the attenuators 18*a*, 18*b*. The attenuators 18*a*, 18*b* are each controlled by 8 bits words from the slave memory 27.

The signals from the microphone 7, the pick-up-coil 16 and the audio input 3 are added and amplified in the summing amplifier 22*a* and thereafter limited in a limiter 23*a* in order not to saturate a filter 24. The limiting is done with "soft" peak clipping utilizing the non-linearity properties of a diode.

The filter 24 is based on transconductance filters which provide a 4th order Butterworth filter and divides the signal in 3 channels; low-, band- and high-pass. The two crossover frequencies of the filter 24 are independently digitally controlled by two 8 bits words from the slave memory 27, in quarter of an octave steps 190–2.000 Hz and 500–6.000 Hz respectively.

The three output signals from the filter 24 (low-, band- and high-pass) are amplified in amplifiers 14*c*–14*e*, attenuated in attenuators 18*c*–18*e* and limited in limiters 23*b*–23*d* in the same fashion as mentioned earlier. In this way the level of limitation can be controlled digitally independently in each channel. Each of the three signals then pass through digitally controlled attenuators 18*f*–18*h*, where the signal levels in the different channels are set before they are added. After the summing amplifier 22*b* the signal passes a digitally controlled switch 20*b* with the purpose of avoiding disturbance when information is altered in the slave memory 27. After a volume control 26 the signal is amplified in an output amplifier 25, the output being connected to an earphone 8.

A triple averaging detector 19 is connected to each output of the amplifiers 14*c*–14*e*, in order to give signals to the logic unit 21. The purpose of this detector 19 is to cause new data to be automatically shifted into the slave memory 27, when suitable signals trigger the logic unit 21.

The slave memory 27 is a shift-register of 80 bits, which furnishes the above mentioned units with digital information.

The control unit 5 consists of a voltage doubler and regulator 36, a logic unit 21, which receives clock pulses from the voltage doubler and regulator 36, a high voltage sensor 35, and a binary counter 34, which addresses the memory 6, and a digitally controlled switch 20*c*.

The memory 6 in this embodiment is organized in $1\times643$ bits, which means that the memory 6 can provide information for up to eight different listening situations, with 80 bits per listening situation. The three extra bits are used for the logic unit 21 to tell how many listening situations the hearing aid has been programmed for. It could be from two to eight different listening situations.

When the signal processor device 1 is turned on via the power switch 17, the voltage doubler and regulator 36 generates a power reset pulse to the logic unit 21 and the binary counter 34. Immediately after the reset pulse the logic unit 21 operates in the following manner:

- Generates a pulse to the switch 20*b*, connecting poles 1 and 2, during data transfer.
- Sets the memory 6 in read mode during transfer of data.
- Generates eighty-three clockpulses to the counter 34. The three first bits are transferred to the logic unit 21. The remaining eighty bits of data from the memory 6 are transferred to the slave memory 27.
- Generates eighty clock pulses synchronously to the slave memory 27.

The signal processing device 1 is now operating for the first listening situation.

When the hearing aid wearer wants to change the signal processing device 1 for another listening situation he pushes the manual switch 9, which triggers the logic unit 21 and operates in the following manner:

- Generates a pulse to the switch 20*b*, connecting poles 1 and 2, during data transfer.
- Addresses the memory 6 for new location of eighty new bits of information.
- Sets the memory 6 in read mode during data transfer.
- Generates eighty clockpulses to the counter 34. Eighty bits of data from the memory 6 are transferred to the slave memory 27.
- Generates eighty clock pulses synchronously to the slave memory 27.

The signal processing device 1 now operates for the second listening situation. If the hearing aid wearer again pushes the manual switch 9, the process is repeated and the hearing aid operates for a third listening situation.

When the user activates the manual switch 9, and the aid is operating for the last preprogrammed listening situation, as indicated by the above mentioned first three bits, the logic unit 21 again transfers the data for the first listening situation to the slave memory 27. In this way the data information of the different listening modes are transferred to the slave memory 27 in a cyclic manner.

If the hearing aid wearer does not know for which listening mode the hearing aid operates for the moment he turns the aid off and on with the power switch 17 and the hearing aid will operate for the first listening situation.

The control unit 5 can also transfer data automatically to the slave memory 27, if the hearing aid wearer moves from one acoustical listening situation to another. A suitable change in the information from the triple averaging detector 19 triggers the logic unit and new data information is transferred from the memory 6 to the slave memory 27, for that particular listening situation.

When data is written to the memory 6 from an external programming unit 2 or data is read out from the memory 6 to the external programming unit 2, the battery 33 is removed, and a three pole adaptor (not shown in figure) from the programming unit 2 is connected to the battery connectors 28, 29 and to the data input/output 3.

Programming of the memory 6 is always first accomplished by an erase pulse and then all the 643 bits are transferred in series to the memory 6. This is done by raising the voltage to the connector 28 and pulsing it with about 1 kHz and syncronously transferring data from the programming unit 2 via the connector 3 to the memory 6.

The logic unit 21 operates in the following manner when it receives a pulse longer than 200 μs from the high voltage sensor 35.

Generates a pulse to the switches 20*a*, 20*b* and 20*c*, connecting poles 1 and 2, during data transfer.

Sets the memory 6 in erase mode. The total memory area is now erased by the first high voltage pulse about 1 ms long.

Sets the memory 6 in write mode, during data transfer.

Each pulse from the high voltage sensor 35 advances the address word of the memory 6 by one bit, via the logic unit 21 and the counter 34.

With the high voltage pulses, about 1 ms long, to the memory 6, and with data coming syncronously from the programming unit 2 via terminal 3, switches 20*a* and 20*c*, the memory 6 is being programmed.

To transfer data from the memory 6 to the programming unit 2, the logic unit 21 is trigged via the high voltage sensor 35, with one very short high voltage pulse less than 50 μs. The programming unit 2 first generates a pulse to the terminal 3 for incrementing the address word for the memory 6 and then reads the first data bit from the memory 6, again generates a pulse and reads out the next data bit and so on, until all 643 bits are read out in series from the memory 6 to the programming unit 2.

The logic unit 21 operates in the following manner:

Generates a pulse to the switches 20*a*, 20*b* and 20*c*, connecting poles 1 and 2, during data transfer.

Sets the memory 6 in read mode during data transfer.

Each incoming pulse from the programming unit 2 increments the address word for the memory 6 by one bit via the logic unit 21 and the counter 34.

In this manner all data (643 bits) from the memory 6 is transferred to the programming unit 2, via the switches 20*c*, 20*a* and terminal 3.

The invention is of course not limited to the above disclosed embodiment. A number of alternative embodiments are possible within the scope of the claims. Therefore it is possible to use the invention for example in a number of different applications where it is necessary that some signal process automatically or manually should be changed in the signal processing device, when the sound environment or the listening situation is changed. The electronic components can also of cause be of different kinds. For example the memory 6 may be of either a volatile or a nonvolatile type.

We claim:

1. Programmable signal processing device, mainly intended for persons having impaired hearing, and of the kind which include an electronically controlled signal processor, characterized by that a memory is arranged to store information/data for at least two unique signal processes adjusted to different sound environments/listening situations and that a control unit, manual or automatic, is arranged to transmit information/data, for one of the unique signal processes, from the memory to the signal processor, to bring about one signal process adjusted to a particular sound environment/-listening situation.

2. Programmable signal processing device according to claim 1, characterized by that a control gear is arranged to influence the control unit, manually, thus that digital information is transmitted from the memory to the signal processor for specifying the signal process.

3. Programmable signal processing device according to claim 1 characterized by that the signal processor is arranged to influence the control unit automatically, depending on the sound environment, thus that digital information is transmitted from the memory to the signal processor for specifying the signal process.

4. Programmable signal processing device according to any one of the preceding claims, characterized by that a programming unit is connectable to an input-/output terminal and arranged to influence the control unit thus that digital information is transmitted between the programming unit and the memory.

5. Programmable signal processing device according to any one of claims 1–3, characterized by that two attennuators, one switch and a summing amplifier are arranged to balance and adjust signal levels supplied to input terminals from different signal sources, to the actual sound environment/listening situation.

* * * * *

US004425481B1

REEXAMINATION CERTIFICATE (2334th)

United States Patent [19]

[11] B1 4,425,481

Mansgold et al.

[45] Certificate Issued Jul. 12, 1994

[54] PROGRAMMABLE SIGNAL PROCESSING DEVICE

[76] Inventors: Stephan Mansgold, Rådavägen 82 G, Mölnlycke, Sweden, S-435 00; Arne Leijon, Jungmansgatan 57, Göteborg, Sweden, S-413 11; Björn Israelsson, Uddevallagatan 35, Göteborg, Sweden, S-416 70

Reexamination Requests:
No. 90/002,783, Jul. 10, 1992
No. 90/002,519, Nov. 25, 1991
No. 90/002,614, Jan. 8, 1992

Reexamination Certificate for:
Patent No.: 4,425,481
Issued: Jan. 10, 1984
Appl. No.: 368,456
Filed: Apr. 14, 1982

[30] Foreign Application Priority Data

Apr. 16, 1981 [SE] Sweden ..... 8102466

[51] Int. Cl.[5] ..... H04R 25/00

[52] U.S. Cl. ..... 381/68.2; 381/68; 381/98

[58] Field of Search ..... 381/103, 112, 68.2, 381/68.4

[56] References Cited

U.S. PATENT DOCUMENTS

| | | | |
|---|---|---|---|
| 3,571,529 | 3/1971 | Gharib et al. . | |
| 3,927,279 | 12/1975 | Nakamura et al. . | |
| 4,025,721 | 5/1977 | Graupe et al. | 179/1 P |
| 4,185,168 | 1/1980 | Graupe et al. . | |
| 4,187,413 | 2/1980 | Moser | 179/107 |

FOREIGN PATENT DOCUMENTS

| | | |
|---|---|---|
| 2719973 | 12/1977 | Fed. Rep. of Germany . |
| 7501378 | 6/1978 | Japan . |
| 921467 | 6/1979 | Japan . |
| 80/01632 | 8/1980 | PCT Int'l Appl. . |
| 2091065 | 1/1981 | United Kingdom . |

OTHER PUBLICATIONS

Knorr, S. G., "A hearing Aid for Subjects with Extreme High-Frequency Losses", IEEE Transactions on Acoustics, Speech and Signal Processing, Dec., 1976, pp. 473–480.

Rihs et al, "Active Filtering—a Step Toward the Programmable Hearing Aid", Hearing Instruments, vol. 33, No. 10, 1982.

Mangold et al, "Wearable Programmable Hearing Aid with Multi-Channel Compression: Successive Adaptation—An Interdisciplinary Study Based on Subjective and Objective Evaluation Methods", *Chalmers Tekniske Hogskola, Swedish Technical University, Gotherberg, Nov., 1980 (with partial translation).*

Mangold, "Programmable Hearing Aid" *Uses of Computers in Aiding the Disabled,* IFIP-IMIA Working Conference, Haifa, Israel, Nov. 3-5, 1981, pp. 135-146.

S. Mangold et al. "Programmable Hearing Aid With Multichannel Compression," Scan Audiol 8: 121-126, 1979.

Widex A8+T and A8+H Hearing Aids Brochure (1977).

Widex Model S20 Hearing Aid Brochure (1980).

*Audiology,* Gunnar Lidén, Sweden (1975), pp. 238-239 and 246-247 (translation attached).

R. P. Lippmann et al, "Study of Multichannel Amplitude Compression and Linear Amplification For Persons With Sensorineural Hearing Loss," Journal of the Acoustic Society of America, vol. 69, No. 2, Feb. 1981, pp. 524-534.

*Primary Examiner*—Forester W. Isen

[57] ABSTRACT

The invention refers to a programmable signal processing device mainly intended for hearing aids and of the kind which include an electronically controlled signal processor. Hearing aids for persons having impaired hearing are normally adjusted for only one frequency response and are adapted to amplify the frequencies which the patient has difficulties to hear. At different sound environments as for example conversations with disturbing background sounds, normal conversation in quiet environments or at lectures, the conditions of listening are different. Up to now this problem has not

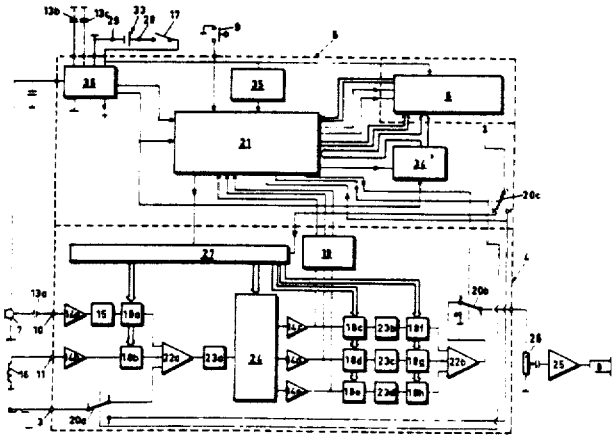

been solved satisfactorily for hearing aids. With the present invention a number of different signal processes, can easily be selected to suit different sound situations automatically or by the user himself. This is accomplished thereby that a memory (6) is arranged to store information/data for at least two unique signal processes adjusted to different sound environments/listening situations and that a control unit (5), manual or automatic, is arranged to transmit information/data, for one of the unique signal processes, from the memory (6) to the signal processor (4), to bring about one signal process adjusted to a particular sound environment/listening situation. (FIG. 1)

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 5 is cancelled.

Claims 1–4 are determined to be patentable as amended.

New claim 6 is added and determined to be patentable.

1. [Programmable signal processing device, mainly intended for persons] *A programmable wearable hearing aid adapted to be used by a person* having impaired hearing [, and of the kind which include] *in a plurality of different sound environments, comprising:* an electronically controlled signal processor [, characterized by that] *with adequate functions for processing a complex input signal containing information such as speech or music from a sound environment according to a unique signal process;* a memory [is] arranged to store *at least two sets of digital* information/data [for]. *each of said* at least two [unique signal processes adjusted to] *sets of digital information/data being programmed to compensate for said hearing impairment of said person and for a* different *one of said plurality of* sound environments [/listening situations]. and [that]

a control unit [, manual or automatic, is arranged] to transmit *one of said at least two sets of digital* information/data [, for one of the unique signal processes,] from the memory to the signal processor, to bring about [one] *said unique* signal process adjusted to a particular *one of said different* sound [environment/listening situation] *environments;*

*said programmable hearing aid being wearable by said person.*

2. [Programmable signal processing device] *A programmable wearable hearing aid* according to claim 1, characterized by that a control gear is arranged to influence the control unit, manually, thus that *said one of at least two sets of* digital information/*data* is transmitted from the memory to the signal processor for specifying the *unique* signal process.

3. [Programmable signal processing device] *A programmable wearable hearing aid* according to claim 1 characterized by that the signal processor is arranged to influence the control unit automatically, depending on the sound environment, thus that digital information is transmitted from the memory to the signal processor for specifying the signal process.

4. [Programmable signal processing device] *A programmable wearable hearing aid* according to any one of the preceding claims, characterized by that a programmable unit is connectable to an input-/ouptut terminal and arranged to influence the control unit thus that digital information is transmitted between the programming unit and the memory.

*6. A programmable wearable hearing aid adapted to be used by a person having a hearing impairment, said programmable wearable hearing being usable in a plurality of different sound environments, comprising:*

*a microphone;*

*an electronically controlled signal processor operatively coupled to said microphone and with adequate functions for processing a complex input signal containing information such as speech or music from a sound environment according to a unique signal process and producing an output signal;*

*an earphone operatively coupled to said ouptut of said signal processor;*

*a memory arranged to store at least two sets of digital information/data, each of said at least two sets of digital information/data being programmed to compensate for said hearing impairment of said person and for a different one of said plurality of sound environments, and*

*a control unit to transmit one of said at least two sets of digital information/data from said memory to said signal processor, to bring about said unique signal process adjusted to a particular one of said different sound environments;*

*said programmable hearing aid being wearable by said person.*

* * * * *

US004425481B2

REEXAMINATION CERTIFICATE (3777th)

United States Patent [19] [11] B2 4,425,481

Mansgold et al. [45] Certificate Issued Jun. 8, 1999

[54] PROGRAMMABLE SIGNAL PROCESSING DEVICE

[75] Inventors: Stephan Mansgold, Mölnlycke; Arne Leijon; Björn Israelsson, both of Göteborg, all of Sweden

[73] Assignee: Resound Corporation, Redwood City, Calif.

Reexamination Requests:
No. 90/003,399, Apr. 15, 1994
No. 90/004,231, Apr. 24, 1996
No. 90/004,754, Jul. 3, 1997

Reexamination Certificate for:

| | |
|---|---|
| Patent No.: | **4,425,481** |
| Issued: | **Jan. 10, 1984** |
| Appl. No.: | **06/368,456** |
| Filed: | **Apr. 14, 1982** |

Reexamination Certificate B1 4,425,481 issued Jul. 12, 1994

[21] Appl. No.: 06/368,456

[30] Foreign Application Priority Data

Apr. 16, 1981 [SE] Sweden ..... 8102466

[51] Int. Cl.[6] ..... H04R 25/00

[52] U.S. Cl. ..... 381/317; 381/98

[58] Field of Search ..... 381/317, 101, 381/320, 102, 98, 103

[56] References Cited

U.S. PATENT DOCUMENTS

| | | | |
|---|---|---|---|
| 3,571,529 | 3/1971 | Gharib et al. . | |
| 3,927,279 | 12/1975 | Nakamura et al. . | |
| 4,025,721 | 5/1977 | Graupe et al. . | |
| 4,185,168 | 1/1980 | Graupe et al. . | |
| 4,187,413 | 2/1980 | Moser . | |
| 4,292,467 | 9/1981 | Odlen et al. | 381/101 |
| 4,363,001 | 12/1982 | Suzuki et al. | 381/101 |

FOREIGN PATENT DOCUMENTS

| | | |
|---|---|---|
| 2719973 | 12/1977 | Germany . |
| 7501378 | 6/1978 | Japan . |
| 921467 | 6/1979 | Japan . |
| 2091065 | 7/1982 | United Kingdom . |
| 80/01632 | 8/1980 | WIPO . |

OTHER PUBLICATIONS

Barfod, J., "Multichannel Compression Hearing Aids: Experiments and Consideration on Clinical Applicability", *Scandinavian Audiology, Supp 6*, 1978.

Barfod, J., "Investigations on the Optimum Correction Frequency–Response for High–Tone Hearing Loss, Report #4", The Acoustic Laboratory, Technical University of Denmark, 1972.

(List continued on next page.)

*Primary Examiner*—Forester W. Isen

[57] ABSTRACT

The invention refers to a programmable signal processing device mainly intended for hearing aids and of the kind which include an electronically controlled signal processor. Hearing aids for persons having impaired hearing are normally adjusted for only one frequency response and are adapted to amplify the frequencies which the patient has difficulties to hear. At different sound environments as for example conversations with disturbing background sounds, normal conversation in quiet environments or at lectures, the conditions of listening are different. Up to now this problem has not been solved satisfactorily for hearing aids. With the present invention a number of different signal processes, can easily be selected to suit different sound situations automatically or by the user himself. This is accomplished thereby that a memory (6) is arranged to store information/data for at least two unique signal processes adjusted to different sound environments/listening situations and that a control unit (5), manual or automatic, is arranged to transmit information/data, for one of the unique signal processes, from the memory (6) to the signal processor (4), to bring about one signal process adjusted to a particular sound environment/listening situation. (FIG. 1).

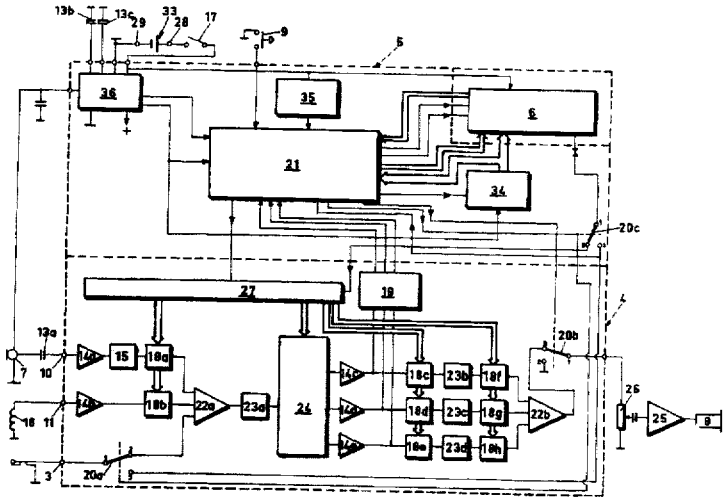

OTHER PUBLICATIONS

Bergenstoff, H., "On the Problems of Fitting an Individual Hearing Aid: A Case Story", *Scandinavian Audiology, Supp 6,* 1978.

Berger, K.W., "Prescription of Hearing Aids: A Rationale", J. American Auditory Socoety, 1976.

Byrne, D., Theoretical Approaches for Hearing Aid Selection, presented at "A Working Conference on Amplification for the Hearing Impaired: Research Needs", Vanderbilt University, Jun. 7–10, 1981.

Byrne, D., Tonisson, W., "Selecting the Gain of Hearing Aids for Persons with Sensorineural Hearing Impairments", *Scandinavian Audiology,* 1976.

Davis, H., et al. "Hearing Aids: An Experimental Study of Design Objectives", Cambridge, Harvard University Press, 1947.

Gabrielsson, A. and Sjogren, H., "Perceived Sound Quality of Hearing Aids", *Scandinavian Audiology,* 8: 159–169, 1979.

Killion, M.C., "Transducers, Earmolds and Sound Quality Consideration", presented at "A Working Conference on Amplification for the Hearing Impaired: Research Needs", Vanderbilt University, Jun. 7–10, 1981.

Levitt, H., "Methods for Evaluation of Hearing Aids", *Scandinavian Audiology, Supp 6,* 1978.

Philips Medicinska Uirusiningar, "AMETIST B".

Ross, M., "Hearing Aid Evaluation", *Handbook of Clinical Audiology,* Jack Katz (ed), 1978, 1984.

Schubert, E.D., *Hearing: It's Function and Dysfunction,* Springer–Verlag, Vienna, 1980.

Schwartz, D.M., "Hearing Aid Selection Methods: An Enigma", presented at "A Working Conference on Amplification for the Hearing Impaired: Research Needs", Vanderbilt Uniersity, Jun. 7–10, 1981.

Skinner, M.W., "Speech Intelligibility in Noise–Induced Hearing Loss: Effects of High–Frequency Compensation", *Ph.D. Dissertation,* Washington University, 1976.

Zenith Hearing Aid Sales Corp., Apr. 1969.

R.P. Lippmann et al, "Study of Multichannel Amplitude Compression and Linear Amplification for Persons with Sensioneural Hearing Loss," Journal of the Acoustic Society of America, vol. 69, No. 2, Feb. 1981, pp. 524–534.

Knorr, S.G., "A hearing Aid for Subjects with Extreme High–Frequency Losses", IEEE Transactions on Acoustics, Speech and Signal Processing, Dec., 1976, pp. 473–480.

Rihs et al, "Active Filtering—a Step Toward the Programmable Hearing Aid", Hearing Instruments, vol. 33, No. 10, 1982.

Mangold et al, "Wearable Programmable Hearing Aid with Multi–Channel Compression: Successive Adaptation—An Interdisciplinary Study Based on Subjective and Objective Evaluation Methods", *Chalmers Takniske Högskola,* Swedish Technical University, Gotherberg, Nov., 1980 (with partial translation).

Mangold, "Programmable Hearing Aid" *Uses of Computers in Aiding the Disabled,* IFIP–IMIA Working Conference, Haifa, Israel, Nov. 3–5, 1981, pp. 135–146.

S. Mangold et al. "Programmable Hearing Aid With Multichannel Compression," Scan Audiol 8: 121–126, 1979.

Widex A8+T and A8+H Hearing Aids Brochure (1977).

Widex Model S20 Hearing Aid Brochure (1980).

Heritage Hearing Aid Brochure (1969).

The Hearing Dealer, Apr. 1969, pp. 16–17.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 5 was previously cancelled.

Claims 1–4, 6 are determined to be patentable as amended.

Claims 7–45 are added and determined to be patentable.

1. A programmable wearable hearing aid adapted to be used by a person having impaired hearing in a plurality of different sound environments, comprising:

an electronically controlled signal processor with adequate functions for processing a complex input signal [containing] *including* information such as speech or music from a sound environment according to a unique *and electrically alterable* signal process, *said electronically controlled signal processor including a frequency separating circuit which separates said input information into different frequency bands, and a selective gain circuit, which adjusts gain of said different frequency bands*;

a memory arranged to store at least two sets of digital information/data, each of said at least two sets of digital information/data *including first and second items of information/data which has information to* [being programmed to compensate for hearing impairment of said person and for a different one of said plurality of sound environments] *adjust a frequency cutoff of said frequency separating circuit, and gain in the frequency bands defined by said frequency cuttoff;*[.] and a control unit *which selects one of said sets of digital information/data and commands an entirety of said one set* [to transmit one of said at least two sets] of digital information/data *to be transmitted* from the memory to the signal processor, to *adjust* [bring about] said unique signal process [adjusted] to *both* a particular one of said different sound environments *and said hearing impairment by adjusting said frequency separating circuit and said selective gain circuit;*

[,to bring about said unique signal process adjusted to a particular one of said different sound environments;]

said programmable hearing aid being wearable by said person.

2. A programmable wearable hearing aid according to claim 1, [characterized by that] *wherein* a control gear is arranged to influence the control unit, manually, [thus] *so* that said one of at least two sets of digital information/data is transmitted from the memory to the signal processor for specifying the unique signal process.

3. A programmable wearable hearing aid according to claim 1, [characterized by that] *wherein* the signal processor is arranged to influence the control unit automatically, depending on the sound environment, [thus] *such* that digital information is transmitted from the memory to the signal processor for specifying the signal process.

4. A programmable wearable hearing aid according to [any one of the preceding claims, characterized by that] *claim 1, wherein* a programmable unit is connectable to an input/output terminal and arranged to influence the control unit, *such* [thus] that digital information is transmitted between the [programming] *programmable* unit and the memory.

6. A programmable wearable hearing aid adapted to be used by a person having a hearing impairment, said programmable wearable hearing aid being usable in a plurality of different sound environments, comprising:

a microphone;

an electronically controlled signal processor operatively coupled to said microphone and with adequate functions for processing a complex input signal [containing] *including* information such as speech or music from a sound environment according to a unique *and electrically alterable* signal process and producing an output signal, *said electronically controlled signal processor including a frequency separating circuit which separates said input information into different frequency bands, and a selective gain circuit which adjusts gain of said different frequency bands*;

an earphone operatively coupled to said output of said signal processor;

a memory arranged to store at least two sets of digital information/data, each of said at least two sets of digital information/data being programmed to compensate for said hearing impairment of said person and for a different one of said plurality of sound environments; and a control unit [to transmit one of said at least two sets] *which selects one of said sets of digital information/data and commands an entirety of said one set* of digital information/data *to be transmitted* from said memory to said signal processor *to adjust said frequency separating circuit and said selective gain circuit*, to bring about said unique signal process adjusted to a particular one of said different sound environments;

said programmable hearing aid being wearable by said person.

*7. A programmable wearable hearing aid adapted to be used by a person having impaired hearing in a plurality of different sound environments, comprising:*

*an electronically controlled signal processor with adequate functions for processing a complex input signal including sound information such as speech or music from a sound environment according to a unique and electrically controlled signal process, said electronically controlled signal processor including a frequency separating circuit which separates said input information into different frequency bands, and a selective gain circuit, which adjusts gain of said different frequency bands;*

*an electrically-addressable digital memory arranged to store at least two sets of digital information/data, each of said at least two sets of digital information/data including information to adjust the input signal to compensate for both said hearing impairment of said person and for a different one of said plurality of sound environments; and*

*a control unit operable to electrically address said digital memory, by providing a first address which reads out an*

*entirety of a first set of digital information/data, and by providing a second address which reads out an entirety of a second set of digital information/data that is different than said first set of digital information/data, said control unit transmitting one of said at least two sets of digital information/data from the memory to the signal processor, to adjust said unique signal process to both a particular one of said different sound environments and said hearing impairment by adjusting a frequency cutoff of said frequency separating circuit, and gain in the frequency bands defined by said frequency cutoff;*

*said programmable hearing aid being wearable by said person.*

*8. A programmable wearable hearing aid according to claim 7, wherein said memory is a read/write memory.*

*9. A programmable wearable hearing aid adapted to be used by a person having impaired having in a plurality of different sound environments, comprising:*

*an electronically controlled signal processor with adequate functions for processing a complex input signal including information such as speech or music from a sound environment according to a unique signal process in which an amount of amplification of said input signal depends on a frequency of said signal, said electronically controlled signal processor including a first compensation circuit which separates said input information into different frequency bands, and a second compensation circuit which adjusts gain of said different frequency bands;*

*an electrically-addressable memory arranged to store at least two sets of digital information/data, each of said at lest two sets of digital information/data including a plurality of bits representing information to compensate for hearing impairment of said person and a different one of said plurality of sound environments; and*

*a control unit which selects one of said sets of digital information/data and commands said plurality of bits forming said one set of digital information/data, as a unit, to be transmitted from the memory to the signal processor to adjust said unique signal process to both a particular one of said different sound environments and said bearing impairment by adjusting said first and second compensation circuits,*

*said programmable hearing aid being wearable by said person.*

*10. A programmable wearable hearing aid according to claim 1, wherein said memory stores said set of data as a unit of data, said control unit addressing said memory whereby a single addressing unit reads out an entire one of said units of data.*

*11. A programmable wearable hearing aid according to claim 1, wherein said gain limits said signal.*

*12. A programmable wearable hearing aid according to claim 1, wherein each of said at least two sets of digital information/data includes multiple bits of information, a plurality of said bits controlling said frequency separating circuit, and others of said bits controlling said selective gain circuit, wherein each of said frequency separating circuit and said selective gain circuit is controlledby multiple bits.*

*13. A programmable wearable hearing aid adapted to be used by a person having impaired hearing in a plurality of different sound environments comprising:*

*an electronically controlled signal processor which includes circuits that operate to process a complex input signal containing sound information from a sound environment according to a unique and electrically alterable signal process, said electronically controlled signal processor including a frequency separating circuit which separated said input information into different frequency bands, and a selective gain circuit, which adjusts gain of said different frequency bands;*

*a memory arranged to store at least two sets of digital information/data, each of said at least two sets of digital information/data being a unit of information which is programmed to compensate for said impaired hearing and one of different sound environments, each said set including a first part which adjusts a frequency cutoff of said frequency separating circuit, and a second part which adjusts gain in the frequency bands defined by said frequency cutoff; and*

*a control unit which selects one of said sets of digital information/data and issues a command which reads out an entirety of said one set of digital information/data, and transmits said one set from the memory to the signal processor to adjust said frequency separating circuit in a first way, and to adjust said selective gain circuit in a first way, and which selects another of said sets of digital information/data and issues a command which reads out an entirety of said another set of digital information/data, and transmits said another set from the memory to the signal processor to adjust at least one of said frequency separating circuit in a second way different than the first way and said selective gain circuit in a second way different than the first way,*

*whereby transmission of the entirety of said one set to said signal processor brings about said unique signal process adjusted to a particular one of said different sound environments;*

*said programmable hearing aid being wearing by said person.*

*14. A programmable wearable hearing aid according to claim 13, wherein said gain limits said signal.*

*15. A programmable wearable hearing aid according to claim 13, wherein said set includes multiple bits of information, a plurality of said bits controlling said frequency separating circuit, and others of said bits controlling said selective gain circuit, wherein each of said circuits is controlled by a group including more than one of said bits.*

*16. A programmable wearable hearing aid adapted to be used by a person having impaired hearing in a plurality of different sound environments, comprising;*

*an electronically controlled signal processor operating to process a complex input signal including sound information according to a unique and electrically alterable signal process, said electronically controlled signal processor including a gain control circuit which adjusts a gain of said input signal, and a frequency selective circuit, which carries out a frequency selective operation on different frequency bands of said input signal;*

*a memory arranged to store at least two sets of digital information/data, each of said at least two sets of digital information/data being a unit of information which is programmed to compensate for said impaired hearing and one of different sound environments, and which is read from said memory as a unit, each said set including a first part which adjusts a gain of said gain control circuit, and a second part which adjusts some aspect of said frequency selective operation of said frequency selective circuit; and*

*a control unit which selects one of said sets of digital information/data and issues a command which reads out an entirety of said one set of digital information/data, and transmits said one set from the memory to the signal processor to adjust said gain control circuit in a first way, and to adjust said frequency selective circuit in a first way, and which selects another of said sets of digital infomation/data and issues a command which reads out an entirety of said another set of digital information/data, and transmits said another set from the memory to the signal processor to adjust at least one of said gain control circuit in a second way different than the first way and said frequency selective circuit in a second way different than the first way,*

*whereby transmission of the entirety of said one set of said signal processor brings about said unique signal process adjusted to a particular one of said different sound environments;*

*said programmable hearing aid being wearable by said person.*

*17. A programmable wearable hearing aid according to claim 1, wherein said memory in a read/write memory.*

*18. A programmable wearable hearing aid according to claim 6, wherein a control gear is arranged to influence the control unit, manually, so that said one of at least two sets of digital information/data is transmitted from the memory to the signal processor for specifying the unique signal process.*

*19. A programmable wearable hearing aid according to claim 6, wherein the signal processor is arranged to influence the control unit automatically, depending on the sound environment, such that digital information is transmitted from the memory to the signal processor for specifying the signal process.*

*20. A programmable wearable hearing aid according to claim 6, wherein a programmable unit is connectable to an input/output terminal and arranged to influence the control unit, such that digital information is transmitted between the programmable unit and the memory.*

*21. A programmable wearable hearing aid according to claim 6, wherein said memory is a read/write memory.*

*22. A programmable wearable hearing aid according to claim 6, wherein said gain limits said signal.*

*23. A programmable wearable hearing aid according to claim 6, wherein each of said at least two sets of digital information/data includes multiple bits of information, a plurality of said bits controlling said frequency separating circuit, and other of said bits controlling said selective gain circuit, wherein each of said frequency separating circuit and said selective gain circuit is controlled by multiple bits.*

*24. A programmable wearable hearing aid according to claim 7, wherein a control gear is arranged to influence the control unit, manually, so that said one of at least two sets of digital information/data is transmitted from the memory to the signal processor for specifying the unique signal process.*

*25. A programmable wearable hearing aid according to claim 7, wherein the signal processor is arranged to influence the control unit automatically, depending on the sound environment, such that digital information is transmitted from the memory to the signal processor for specifying the signal process.*

*26. A programmable wearable hearing aid according to claim 7, wherein a programmable unit is connectable to an input/output terminal and arranged to influence the control unit, such that digital information is transmitted between the programmable unit and the memory.*

*27. A programmable wearable hearing aid according to claim 7, wherein said memory is a read/write memory.*

*28. A programmable wearable hearing aid according to claim 7, wherein said gain limits said signal.*

*29. A programmable wearable hearing aid according to claim 7, wherein each of said at least two sets of digital information/data includes multiple bits of information, a plurality of said bits controlling said frequency separating circuit, and others of said bits controlling said selective gain circuit, wherein each of said frequency separating circuit and said selective gain circuit is controlled by multiple bits.*

*30. A programmable wearable hearing aid according to claim 9, wherein a control gear is arranged to influence the control unit, manually, so that siad one of at least two sets of digital information/data is transmitted from the memory to the signal processor for specifying the unique signal process.*

*31. A programmable wearable hearing aid according to claim 9, wherein the signal processor is arranged to influence the control unit automatically, depending on the sound environment, such that digital information is transmitted from the memory to the signal processor for specifying the signal process.*

*32. A programmable wearable hearing aid according to claim 9, wherein a programmable unit is connectable to an input/output terminal and arranged in influence the control unit, such that digital information is transmitted between the programmable unit and the memory.*

*33. A programmable wearable hearing aid according to claim 9, wherein said memory is a read/write memory.*

*34. A programmable wearable hearing aid according to claim 9, wherein said gain limits said signal.*

*35. A programmable wearable hearing aid according to claim 9, wherein each of said at least two sets of digital information/data includes multiple bits of information, a plurality of said bits controlling said frequency separating circuit, and others of said bits controlling said selective gain circuit, wherein each of said frequency separating circuit and said selective gain circuit is controlled by multiple bits.*

*36. A programmable wearable hearing aid according to claim 13, wherein a control gear is arranged to influence the control unit, manually, so that said one of at least two sets of digital information/data is transmitted from the memory to the signal processor for specifying the unique signal process.*

*37. A programmable wearable hearing aid according to claim 13, wherein the signal processor is arranged to influence the control unit automatically, depending on the sound environment, such that digital information is transmitted from the memory to the signal processor for specifying the signal process.*

*38. A programmable wearable hearing aid according to claim 13, wherein a programmable unit is connectable to an input/output terminal and arranged to influence the control unit, such that digital information is transmitted between the programmable unit and the memory.*

*39. A programmable wearable hearing aid according to claim 13, wherein said memory is a read/write memory.*

*40. A programmable wearable hearing aid according to claim 16, wherein a control gear is arranged to influence the*

*control unit, manually, so that said one of at least two sets of digital information/data is transmitted from the memory to the signal processor for specifying the unique signal process.*

*41. A programmable wearable hearing aid according to claim 16, wherein the signal processor is arranged to influence the control unit automatically, depending on the sound environment, such that digital information is transmitted from the memory to the signal processor for specifying the signal process.*

*42. A programmable wearable hearing aid according to claim 16, wherein a programmable unit is connectable to an input/output terminal and arranged to influence the control unit, such that digital information is transmitted between the programmable unit and the memory.*

*43. A programmable wearable hearing aid according to claim 16, wherein said memory is a read/write memory.*

*44. A programmable wearable hearing aid according to claim 16, wherein said gain limits said signal.*

*45. A programmable wearable hearing aid according to claim 16, wherein each of said at least two sets of digital information/data includes multiple bits of information, a plurality of said bits controlling said frequency separating circuit, and others of said bits controlling said selective gain circuit, wherein each of said frequency separating circuit and said selective gain circuit is controlled by multiple bits.*

* * * * *